US007853163B2

(12) United States Patent
Katsura et al.

(10) Patent No.: US 7,853,163 B2
(45) Date of Patent: Dec. 14, 2010

(54) FIXING DEVICE AND IMAGE FORMING APPARATUS

(75) Inventors: Norichika Katsura, Tenri (JP); Tadasu Taniguchi, Uda (JP); Masahiko Fujita, Nara (JP); Masaharu Kimura, Daito (JP)

(73) Assignee: Sharp Kabushiki Kaisha, Osaka (JP)

( * ) Notice: Subject to any disclaimer, the term of this patent is extended or adjusted under 35 U.S.C. 154(b) by 162 days.

(21) Appl. No.: 12/370,691

(22) Filed: Feb. 13, 2009

(65) Prior Publication Data

US 2009/0208236 A1 Aug. 20, 2009

(30) Foreign Application Priority Data

Feb. 15, 2008 (JP) ..... 2008-035352

(51) Int. Cl.
*G03G 15/20* (2006.01)
*G03G 15/00* (2006.01)

(52) U.S. Cl. ..... 399/68; 399/45

(58) Field of Classification Search ..... 399/45, 399/67, 68, 322; 347/156
See application file for complete search history.

(56) References Cited

U.S. PATENT DOCUMENTS

| | | | | |
|---|---|---|---|---|
| 5,600,424 | A * | 2/1997 | Malachowski | 399/68 |
| 6,411,785 | B1 * | 6/2002 | Ogawahara et al. | 399/45 X |
| 7,130,549 | B2 * | 10/2006 | Aono et al. | 399/45 |
| 7,657,200 | B2 * | 2/2010 | Nogami | 399/68 |
| 2007/0292154 | A1 * | 12/2007 | Ishikuro et al. | 399/67 |

FOREIGN PATENT DOCUMENTS

| | | |
|---|---|---|
| JP | 09-286529 | 11/1997 |
| JP | 2001-290382 | 10/2001 |
| JP | 2004-157283 | 6/2004 |

* cited by examiner

*Primary Examiner*—Sandra L Brase
(74) *Attorney, Agent, or Firm*—Renner, Otto, Boisselle & Sklar, LLP

(57) ABSTRACT

In a fixing unit, a fixing roller is rotated under driving force transmitted from a paper discharge unit-side gear of a driving section via a fixing roller driving gear, and holds and conveys a recording medium in cooperation with a pressure roller in a nip region. When a control section determines that acceleration conditions are fulfilled, the driving section increases the rotating speed of the paper discharge unit-side gear so that it is rotated at higher speed than before-acceleration speed over predetermined high-speed rotating period.

9 Claims, 10 Drawing Sheets

FIXING DEVICE AND IMAGE FORMING APPARATUS

CROSS-REFERENCE TO RELATED APPLICATION

This application claims priority to Japanese Patent Application No. 2008-035352, which was filed on Feb. 15, 2008, the contents of which are incorporated herein by reference in its entirety.

BACKGROUND OF THE INVENTION

1. Field of the Invention

The present invention relates to a fixing device for fixing a toner image formed on a recording medium onto the recording medium, as well as to an image forming apparatus having the fixing device.

2. Description of the Related Art

An electrophotographic image forming apparatus for forming images by means of electrophotography, such as a copying machine and a printer, is provided with a fixing device. As the fixing device, as shown in FIG. 2 for explaining the invention which will hereafter be described, there is known a fixing device 7 having a heat roller 71 which is heated by a heating portion and a pressure roller 72 which is brought into contact with the heat roller 71 under a predetermined contact pressure. In the fixing device 7, a recording medium, for example, a recording sheet 202 having a yet-to-be heated developer e.g. toner T transferred on its image surface i.e. heat-roller 71-side surface 202*a* by a transfer device located anteriorly of the fixing device 7, is caused to pass through a region between the heat roller 71 and the pressure roller 72, whereupon the yet-to-be heated developer is fixed onto the recording sheet 202.

In order to convey the recording medium, the fixing device 7 has a post-fixing roller 75 and a post-fixing driven roller element 76 which rotates depending on the rotation of the post-fixing roller 75 that are located posteriorly of the heat roller 71 in a direction in which the recording medium is conveyed; that is, located downstream from the heat roller 71 in the conveyance direction. As the post-fixing roller 75 is rotated, with the recording medium 202 caught in the space between the post-fixing roller 75 and the post-fixing driven roller element 76, these rollers convey the recording medium 202.

As shown in FIG. 4 for explaining the invention which will hereafter be described, in the heat roller 71, a key 222 formed in a fixing roller driving gear 220, which is a gear wheel of the fixing roller, is fitted to a keyway 221 formed in a journal 200 extending from a roller main body 201, whereby the fixing roller driving gear 220 and the roller main body 201 are coupled to each other and are thus allowed to rotate together.

In order to rotate the heat roller 71 and the post-fixing roller 75, as shown in FIG. 3 for explaining the invention which will hereafter be described, a paper discharge unit-side gear 211, which is a driving gear wheel engageable with the fixing roller driving gear 220, is rotated by a non-illustrated motor, thus causing the fixing roller driving gear 220 to rotate. The driving force exerted by the motor is transmitted from the paper discharge unit-side gear 211, through the fixing roller driving gear 220, to the heat roller 71. The post-fixing roller 75 is rotated under the driving force transmitted from the fixing roller driving gear 220, through a first coupling gear 230 and a second coupling gear 231, to a post-fixing roller driving gear 232.

Returning to FIG. 2, the heat roller 71 and the pressure roller 72 are each constructed of an elastic roller. Therefore, in a case where the recording medium 202 is of the type that has a certain degree of thickness, such as gloss paper or heavy paper, upon the passage of the recording medium 202 through a nip region 203, the heat roller 71 and the pressure roller 72 undergo elastic deformation owing to the recording medium 202, in consequence whereof there results a buildup of elastic energy in the rollers 71 and 72. The elastic energy is released when the recording medium 202 comes out of the nip region 203, thus causing speeding up of the heat roller 71 and the pressure roller 72. With the resultant accelerated rotation of the heat roller 71, the fixing roller driving gear 220 shown in FIG. 3 is rotated after a moment of speeding up, with the result that so-called tooth jumping occurs between the fixing roller driving gear 220 and the paper discharge unit-side gear 211.

Upon the re-engagement between the fixing roller driving gear 220 and the paper discharge unit-side gear 211, the recording medium 202 is returned to a normally conveyed state where the tooth jumping has not occurred as yet. However, as shown in FIG. 6 which will hereafter be explained, until such time that the fixing roller driving gear 220 and the paper discharge unit-side gear 211 engage with each other, the recording medium 202 is standing still, with its upstream-side end in the conveyance direction A (hereafter referred to as "tail end") 202*b* kept at a position to which it is moved immediately after coming out of the nip region 203. During that time, inconveniently, the post-fixing driven roller element 76 kept in contact with the image surface 202*a* leaves some impressions on the image.

A technique to prevent jumping of gear teeth, although it is not related to fixing device development, is disclosed in Japanese Unexamined Patent Publication JP-A 9-286529 (1997). JP-A 9-286529 discloses a sheet feeding apparatus. In the sheet feeding apparatus disclosed in JP-A 9-286529, when a paper-feeding roller is put under a load which is greater than a predetermined level, the engagement between the paper-feeding roller and a driving shaft is released so that only the driving shaft is rotated, that is, the driving shaft is idled. This makes it possible to reduce the load applied to the driving gear and thereby prevent occurrence of tooth jumping in the driving gear.

When, in the fixing device, the driving shaft is idled to prevent occurrence of tooth jumping in the fixing roller driving gear corresponding to the driving gear as in the technique disclosed in JP-A 9-286529, the conveyance of the recording medium will be brought to a stop. Therefore, just as in the case where the tooth jumping occurs, the post-fixing driven roller element leaves some impressions on the image surface. The technique disclosed in JP-A 9-286529 is thus not applicable to the fixing device.

SUMMARY OF THE INVENTION

An object of the invention is to provide a fixing device capable of preventing conveyance of a recording medium from being impeded in the presence of variation in a drive load on a fixing roller, as well as to provide an image forming apparatus having the fixing device.

The invention provides a fixing device for fixing a toner image formed on a recording medium, onto the recording medium, comprising:

a fixing roller having a gear wheel, the fixing roller being driven to rotate about a predetermined axis of rotation under a driving force transmitted thereto via the gear wheel;

a pressure roller disposed in pressure-contact with the fixing roller so as to be rotatable depending on a rotation of the fixing roller, the pressure roller holding and conveying a recording medium on which is formed a toner image in cooperation with the fixing roller in a nip region where the pressure roller and the fixing roller abut against each other;

a driving section having a driving gear wheel engageable with the gear wheel of the fixing roller, for driving the fixing roller by rotating the driving gear wheel; and a control section for, after determining that conditions for acceleration including coincidence between a nip region-to-recording medium positional relationship and a predetermined acceleration-adapted positional relationship are fulfilled, effecting control of the driving section in a manner so as to increase a rotating speed of the driving gear wheel to allow the driving gear wheel to rotate at a rotating speed higher than a before-acceleration rotating speed over a predetermined high-speed rotating period.

According to the invention, when the driving gear wheel is rotated by the driving section, a driving force is transmitted to the fixing roller via the gear wheel of the fixing roller engageable with the driving gear wheel, thus driving the fixing roller to rotate about the axis of rotation. As the fixing roller is rotated, the pressure roller kept in pressure-contact therewith is rotated depending on the rotation of the fixing roller. In the nip region where the fixing roller and the pressure roller abut against each other, the recording medium on which is formed a toner image is held and conveyed, whereupon the toner image is fixed onto the recording medium. When it is determined by the control section that the conditions for acceleration are fulfilled, then the rotating speed of the driving gear wheel is increased by the driving section which is controlled by the control section, so that the driving gear wheel can be rotated at a rotating speed higher than the before-acceleration rotating speed over the high-speed rotating period. The conditions for acceleration include the coincidence between the nip region-to-recording medium positional relationship and the predetermined acceleration-adapted positional relationship. Therefore, when the drive load on the fixing roller is caused to vary due to the interaction between the nip region and the recording medium, for example, when the fixing roller undergoes speeding up through application of a force other than the driving force transmitted thereto from the driving section via the gear wheel of the fixing roller, the tuning speed of the driving gear wheel can be increased. This makes it possible to prevent occurrence of tooth jumping between the gear wheel of the fixing roller and the driving gear wheel, and thereby prevent the conveyance of the recording medium from being impeded. Accordingly, for example, in a case of disposing a post-fixing driven roller element downstream from the nip region in a direction in which the recording medium is conveyed, it is possible to protect the recording medium from impressions made by the post-fixing driven roller element.

Further, in the invention, it is preferable that the acceleration-adapted positional relationship is a positional relationship between the recording medium and the nip region established at a point of time when an upstream-side end of the recording medium in its conveyance direction reaches the nip region.

According to the invention, the acceleration-adapted positional relationship is the positional relationship between the recording medium and the nip region established at the point of time when the upstream-side end of the recording medium in the conveyance direction reaches the nip region. In this case, upon the arrival at the nip region of the upstream-side end of the recording medium in the conveyance direction, the rotating speed of the driving gear wheel can be increased by the driving section. Accordingly, when the upstream-side end of the recording medium in the conveyance direction passes through the nip region, the driving gear wheel can be rotated at a rotating speed higher than the before-acceleration rotating speed. This makes it possible to prevent occurrence of tooth jumping between the gear wheel of the fixing roller and the driving gear wheel, and thereby prevent the conveyance of the recording medium from being impeded. Thus, for example, in a case of disposing a post-fixing driven roller element downstream from the nip region in the recording-medium conveyance direction, it is possible to protect the recording medium from impressions made by the post-fixing driven roller element.

Furthermore, in the invention, it is preferable that the high-speed rotating period is set to a predicted value of the time which has elapsed between the arrival at the nip region of the upstream-side end of the recording medium in the conveyance direction and the completion of passage of the end through the entire nip region.

According to the invention, the high-speed rotating period is set to a predicted value of the time which has elapsed between the arrival at the nip region of the upstream-side end of the recording medium in the conveyance direction and the completion of passage of the end through the entire nip region. In this way, during the time the upstream-side end of the recording medium in the conveyance direction is expected to be passing through the nip region, the driving gear wheel can be rotated at a rotating speed higher than that at which it is rotated before the upstream-side end of the recording medium in the conveyance direction reaches the nip region. Accordingly, occurrence of tooth jumping between the gear wheel of the fixing roller and the driving gear wheel can be prevented more reliably, wherefore the conveyance of the recording medium can be prevented from being impeded more reliably.

Furthermore, in the invention, it is preferable that the control section controls the driving section in such a manner that, among the rotating speeds of the driving gear wheel for the duration of passage of the upstream-side end of the recording medium in the conveyance direction through the nip region, a rotating speed of the driving gear wheel for a point of time when the end passes through a midportion between both ends of the nip region in the recording-medium conveyance direction rises to a maximum.

According to the invention, the driving section is controlled by the control section in such a manner that, among the rotating speeds of the driving gear wheel for the duration of passage of the upstream-side end of the recording medium in the conveyance direction through the nip region, the rotating speed of the driving gear wheel for the point of time when the upstream-side end of the recording medium in the conveyance direction passes through the midportion between both ends of the nip region in the recording-medium conveyance direction rises to a maximum. This makes it possible to prevent occurrence of tooth jumping between the gear wheel of the fixing roller and the driving gear wheel more reliably, and thereby prevent the conveyance of the recording medium from being impeded more reliably.

Furthermore, in the invention, it is preferable that, after determining that the upstream-side end of the recording medium in the conveyance direction has passed through the midportion between both ends of the nip region in the recording-medium conveyance direction, the control section effects control of the driving section in a manner so as to decrease the rotating speed of the driving gear wheel.

According to the invention, when it is determined by the control section that the upstream-side end of the recording medium in the conveyance direction has passed through the midportion between both ends of the nip region in the recording-medium conveyance direction, the rotating speed of the driving gear wheel is decreased by the driving section. In this way, when the rotating speed of the driving gear wheel is returned to the before-acceleration rotating speed following the passage of the upstream-side end of the recording medium in the conveyance direction through the nip region, it is possible to alleviate the change of the rotating speed of the driving gear wheel, and thereby achieve smooth conveyance of the recording medium.

Furthermore, in the invention, it is preferable that the fixing device further comprises a detecting section which is located upstream of the nip region in the recording-medium conveyance direction, for detecting the recording medium, and the control section determines, when a length of time that has elapsed since recording-medium detection by the detecting section is found to be greater than or equal to a predetermined waiting time for acceleration, that the positional relationship between the nip region and the recording medium conforms to the acceleration-adapted positional relationship.

According to the invention, the recording medium is detected by the detecting section located upstream of the nip region in the recording-medium conveyance direction. When the length of time that has elapsed since recording-medium detection by the detecting section is found to be greater than or equal to the waiting time for acceleration, then the control section determines that the positional relationship between the nip region and the recording medium conforms to the acceleration-adapted positional relationship. In consequence, the rotating speed of the driving gear wheel is increased by the driving section. By selecting the waiting time for acceleration in an appropriate manner, it is possible to increase the rotating speed of the driving gear wheel when a predetermined part of the recording medium reaches the nip region. Accordingly, occurrence of tooth jumping between the gear wheel of the fixing roller and the driving gear wheel can be prevented more reliably, wherefore the conveyance of the recording medium can be prevented from being impeded more reliably.

Further, in the invention, it is preferable that the waiting time for acceleration is set to a predicted value of the time which has elapsed between recording-medium detection by the detecting section and the arrival at the nip region of the upstream-side end of the recording medium in the conveyance direction.

According to the invention, the waiting time for acceleration is set to a predicted value of the time which has elapsed between recording-medium detection by the detecting section and the arrival at the nip region of the upstream-side end of the recording medium in the conveyance direction. In this way, when it is expected that the upstream-side end of the recording medium in the conveyance direction has reached the nip region, the rotating speed of the driving gear wheel can be increased by the driving section. This makes it possible to prevent occurrence of tooth jumping between the gear wheel of the fixing roller and the driving gear wheel more reliably, and thereby prevent the conveyance of the recording medium from being impeded. Thus, for example, in a case of disposing a post-fixing driven roller element downstream from the nip region in the recording-medium conveyance direction, it is possible to protect the recording medium from impressions made by the post-fixing driven roller element.

Furthermore, in the invention, it is preferable that the conditions for acceleration include a condition that the thickness dimension of the recording medium is greater than or equal to a predetermined acceleration-adapted thickness dimension.

According to the invention, the conditions for acceleration include a condition that the thickness dimension of the recording medium is greater than or equal to the acceleration-adapted thickness dimension. When it is determined by the control section that the thickness dimension of the recording medium is greater than or equal to the acceleration-adapted thickness dimension, then the rotating speed of the driving gear wheel is increased by the driving section. In this way, in the case where the thickness dimension of the recording medium is greater than or equal-to the acceleration-adapted thickness dimension, when the recording medium passes through the nip region, the driving gear wheel can be rotated at a rotating speed higher than the before-acceleration rotating speed. This makes it possible to prevent occurrence of tooth jumping between the gear wheel of the fixing roller and the driving gear wheel, and thereby prevent the conveyance of the recording medium from being impeded. Thus, for example, in a case of disposing a post-fixing driven roller element downstream from the nip region in the recording-medium conveyance direction, it is possible to protect the recording medium from impressions made by the post-fixing driven roller element.

Furthermore, the invention provides an image forming apparatus comprising:

a toner image forming section for forming a toner image on a recording medium; and the fixing device mentioned above, for fixing the toner image formed on the recording medium.

According to the invention, the image forming apparatus comprises the toner image forming section and the fixing device of the invention. A toner image is formed on a recording medium by the toner image forming section, and the toner image is fixed onto the recording medium by the fixing device of the invention. As has already been described, in the fixing device of the invention, occurrence of tooth jumping between the gear wheel of the fixing roller and the driving gear wheel can be prevented, wherefore the conveyance of the recording medium can be prevented from being impeded. Thus, for example, in a case of disposing a post-fixing driven roller element downstream from the nip region in the recording-medium conveyance direction, it is possible to protect the recording medium from impressions made by the post-fixing driven roller element. Accordingly, with the provision of the fixing device of the invention, it is possible to realize an image forming apparatus capable of forming high-quality images free from impressions made by a roller such as the post-fixing driven roller element.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
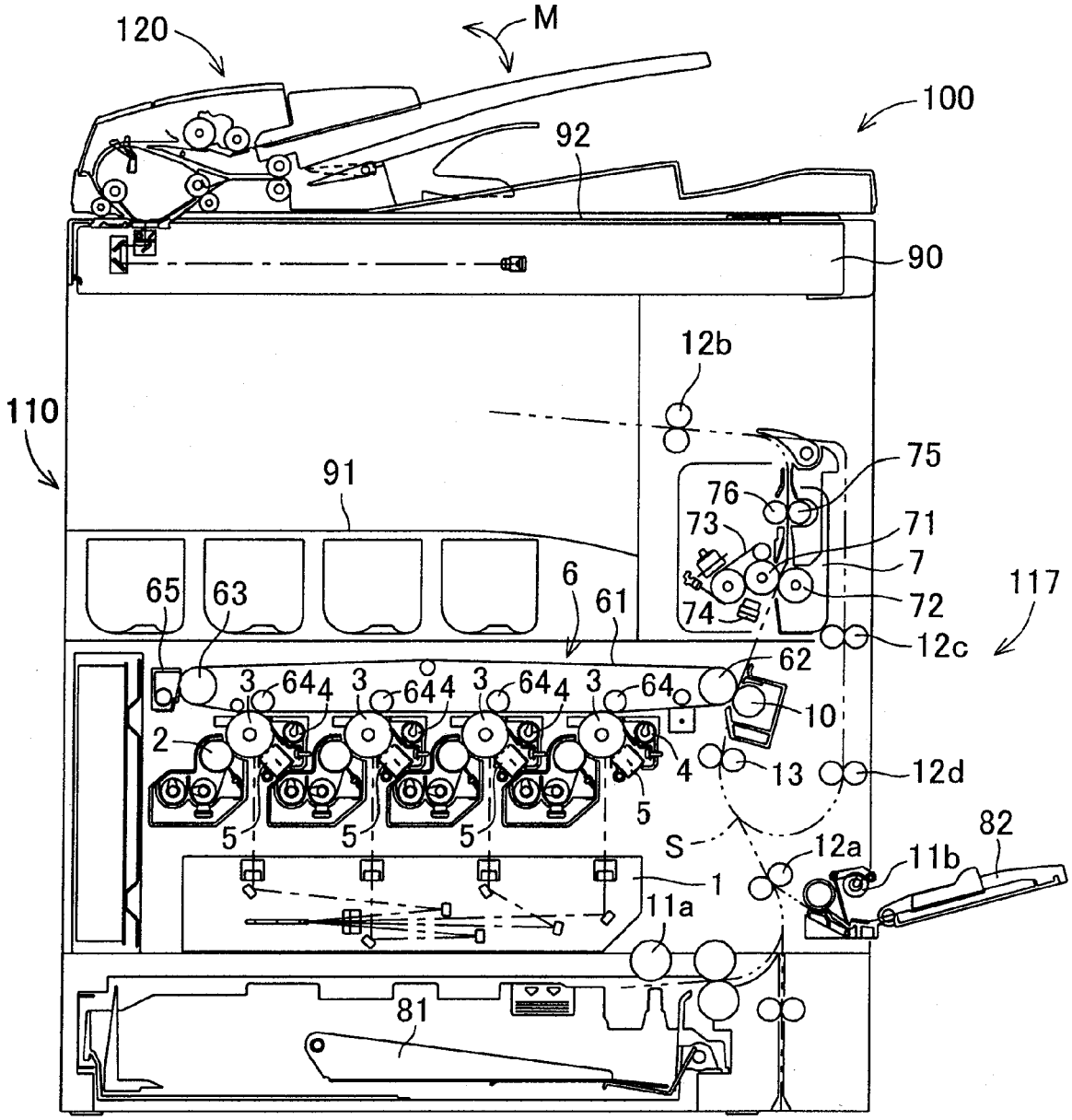
FIG. 1 is a schematic diagram showing the structure of an image forming apparatus having a fixing unit which is a fixing device according to one embodiment of the invention.

Now referring to the drawings, preferred embodiments of the invention will be described in detail.

Figure 8:
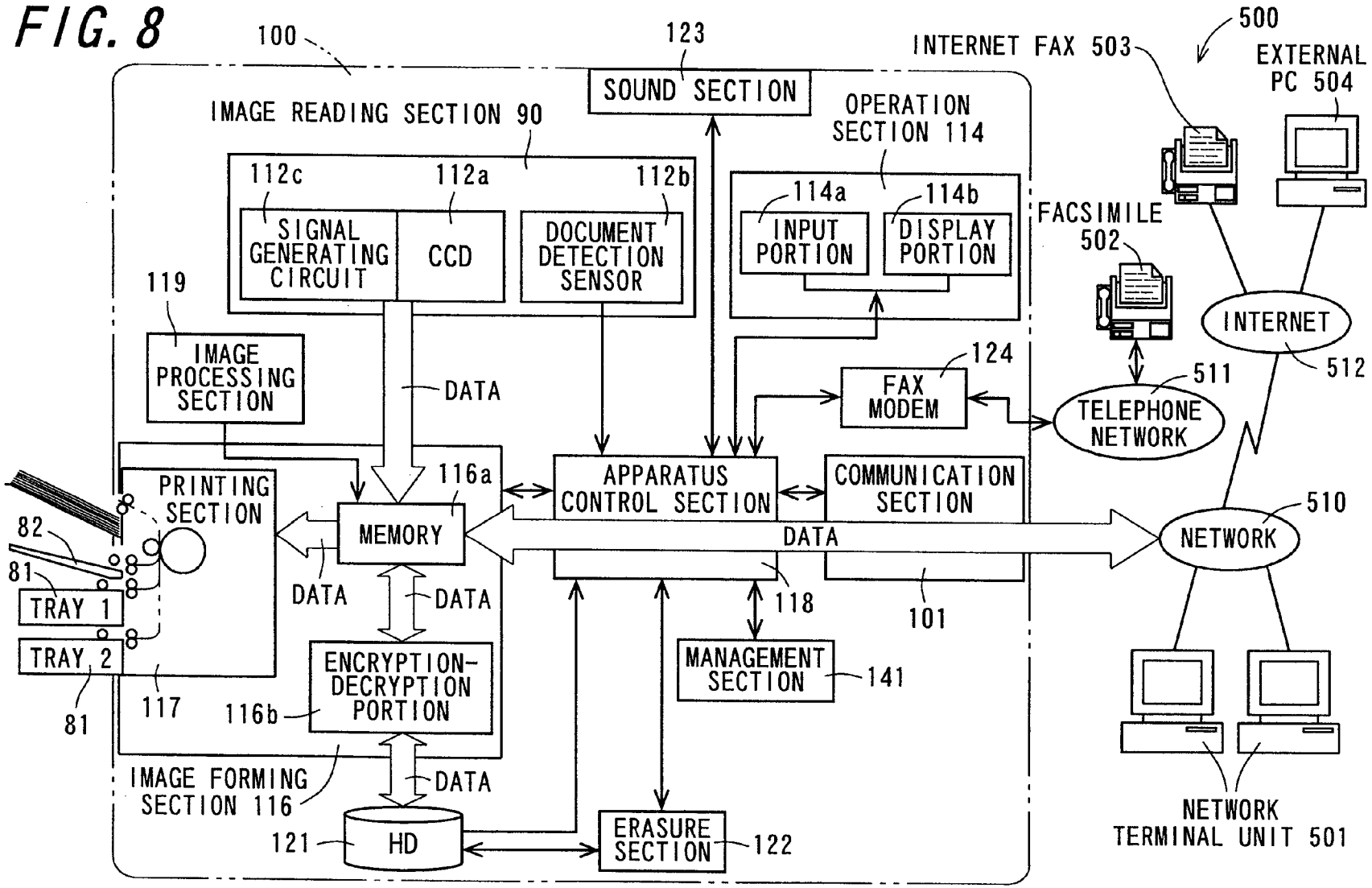
FIG. 8 is a block diagram showing the electrical configuration of the image forming apparatus according to the embodiment.

FIG. 1 is a schematic diagram showing the structure of an image forming apparatus 100 having a fixing unit 7 which is a fixing device according to one embodiment of the invention. The image forming apparatus 100 is designed to form multi-color or one-color images on a predetermined recording medium, for example, a sheet-like recording medium such as recording paper (hereafter also referred to as "recording sheet") in accordance with externally-transmitted image data. The image forming apparatus 100 comprises an apparatus main body 110 and an automatic document processing device 120. The apparatus main body 110 comprises an image reading section 90, an exposure unit 1, a developing device 2, a photoreceptor drum 3, a cleaner unit 4, a charging device 5, an intermediate transfer belt unit 6, a fixing unit 7, a paper-feeding cassette 81, a manual paper-feeding cassette 82, and a paper catch tray 91. The exposure unit 1, the developing device 2, the photoreceptor drum 3, the charging device 5, and the intermediate transfer belt unit 6 function as a toner image forming section. The exposure unit 1, the developing device 2, the photoreceptor drum 3, the cleaner unit 4, the charging device 5, the intermediate transfer belt unit 6, and the fixing unit 7 constitute a printing section 117. The printing section 117 is included in an image forming section 116 as shown in FIG. 8 that will hereafter be described.

With the image forming apparatus 100 placed on a horizontal plane, at the top of the apparatus main body 110 is disposed a document platen 92 made of a light-transmitting glass on which is placed a document. On the top side of the document platen 92 is mounted the automatic document processing device 120. The automatic document processing device 120 conveys a document onto the document platen 92 automatically. Moreover, since the automatic document processing device 120 is so designed as to be rotatable in a direction indicated by an arrow M, it follows that a user is able to place a document with his/her hands by leaving the top of the document platen 92 open.

Image data to be processed in the image forming apparatus 100 of this embodiment corresponds to a color image of black (K), cyan (C), magenta (M), and yellow (Y). In order to form latent images of the four colors on an individual basis, the developing device 2, the photoreceptor drum 3, the charging device 5, and the cleaner unit 4 are each correspondingly four in number to deal with black, cyan, magenta, and yellow, respectively. In this way, four units of image stations are made up.

The charging device 5 serves as a charging section for uniformly charging the surface of the photoreceptor drum 3 to a predetermined potential. While, in this embodiment, the charging device 5 is realized by using a charging device of non-contact charger type, instead of a charger-type charging device as shown in FIG. 1, a charging device of contact roller type or the one of contact brush type may be employed in another embodiment of the invention.

The exposure unit 1, which is an optical scanning device, to be more specific, an image writing device, is built as a laser scanning unit (LSU for short) having a laser emitting section, a reflection mirror, and so forth. In the exposure unit 1 are arranged a polygon mirror for scanning laser beams and optical elements such as a lens and a mirror for directing laser light reflected from the polygon mirror to the photoreceptor drum 3. In another embodiment of the invention, the exposure unit 1 may be built as a writing head comprising light-emitting elements e.g. electroluminescence (EL for short) elements or light-emitting diodes (LED for short) arranged in an array.

The exposure unit 1 has the function of exposing the photoreceptor drum 3 in a charged state to light in accordance with inputted image data to thereby form an electrostatic latent image corresponding to the image data on the surface of the photoreceptor drum 3. The developing device 2 turns the electrostatic latent images formed on their respective photoreceptor drums 3 into visual images by means of toners of four colors (YMCK). Moreover, the cleaner unit 4 removes and collects residual toner remaining on the surface of the photoreceptor drum 3 following the completion of development and image transfer process.

The intermediate transfer belt unit 6 located above the photoreceptor drums 3 comprises an intermediate transfer belt 61, an intermediate transfer belt driving roller 62, an intermediate transfer belt driven roller 63, an intermediate transfer roller 64, and an intermediate transfer belt cleaning unit 65. Four pieces of the intermediate transfer rollers 64 are provided to deal with the colors YMCK on an individual basis.

The intermediate transfer belt driving roller 62, the intermediate transfer belt driven roller 63, and the intermediate transfer rollers 64 allow the intermediate transfer belt 61 to be rotatably driven while being suspended in a tensioned state. Moreover, the intermediate transfer rollers 64 impart a transfer bias to transfer a toner image borne on the photoreceptor drum 3 onto the intermediate transfer belt 61.

The intermediate transfer belt 61 is disposed in contact with each of the photoreceptor drums 3. As for the function of the intermediate transfer belt 61, the toner images of four colors formed on the photoreceptor drums 3 are transferred and overlaid one after another onto the intermediate transfer belt 61, whereupon a color toner image (multi-color toner image) is formed on the intermediate transfer belt 61. For example, the intermediate transfer belt 61 is constructed of a film having a thickness of ca. 100 to 150 μm in an endless belt shape.

Transfer of toner images from the photoreceptor drum 3 to the intermediate transfer belt 61 is effected by the intermediate transfer roller 64 kept in contact with the reverse side of the intermediate transfer belt 61. The intermediate transfer roller 64 receives application of a high-voltage transfer bias for toner-image transfer, to be more specific, a high voltage of a polarity reverse to the polarity of charge on the toner. For example, if the polarity of charge on the toner is negative (−), a positive (+) high voltage is applied to the intermediate transfer roller 64. The intermediate transfer roller 64 is, for example, a roller constructed of a metal (e.g. stainless)-made shaft of 8 to 10 mm in diameter used as a base, the surface of which is covered with a conductive elastic material (such for example as EPDM and urethane foam). By virtue of the conductive elastic material, a high voltage can be uniformly impressed on the intermediate transfer belt 61. While, in this embodiment, a roller-shaped component is used as the transfer electrode, a brush-shaped component may be used instead.

As described above, the toner images obtained as the result of visualization of the electrostatic latent images on the photoreceptor drums 3 in accordance with the different colors are stacked on top of each other on the intermediate transfer belt 61. The thereby stacked, image data-based toner images are moved, as the intermediate transfer belt 61 is rotated, to a location where the recording sheet and the intermediate transfer belt 61 make contact with each other so as to be transferred onto the recording sheet by a transfer roller 10 disposed at the aforementioned contact location.

At this time, the intermediate transfer belt 61 and the transfer roller 10 are brought into pressure-contact with each other in a nip region having a predetermined dimension. Moreover, the transfer roller 10 receives application of a voltage for transferring the toner onto the recording sheet, to be more specific, a high voltage of a polarity reverse to the polarity of charge on the toner. For example, if the polarity of charge on the toner is negative (−), a positive (+) high voltage is applied to the transfer roller 10. Further, in order to obtain the nip region steadily, in constructing the transfer roller 10 and the intermediate transfer belt driving roller 62, one of them is made of a hard material (metal, etc.) and the other is made of a soft material such as an elastic roller element (elastic rubber roller, resin foam roller, etc.).

Furthermore, as described above, the toner that adhered to the intermediate transfer belt 61 upon contact with the photoreceptor drum 3, or the toner that remains on the intermediate transfer belt 61 due to the transfer roller 10 having not effected transfer on the paper sheet, is causative of mixing of toner colors in the subsequent process steps. Therefore, in this construction, the adherent/residual toner is removed and collected by the intermediate transfer belt cleaning unit 65. The intermediate transfer belt cleaning unit 65 is provided with a cleaning blade as a cleaning member which is brought into contact with the intermediate transfer belt 61. The intermediate transfer belt 61 contacted by the cleaning blade is supported, at its back side, by the intermediate transfer belt driven roller 63.

The paper-feeding cassette 81 is a tray on which recording sheets e.g. pieces of recording paper for use in image formation are piled up. In a state where the image forming apparatus 100 is placed on a horizontal plane, the paper-feeding cassette 81 is disposed below the exposure unit 1 of the apparatus main body 110. Moreover, recording sheets for use in image formation can be placed on the manual paper-feeding cassette 82, too. Further, the paper catch tray 91 disposed on the upper part of the apparatus main body 110 is a tray on which printed recording sheets, namely recording sheets having printed images are accumulated in a face-down manner; that is, the recording sheets are accumulated, with their toner image-bearing surfaces pointing downward.

In addition, in the apparatus main body 110 is provided a sheet conveyance path S in substantially vertical form for allowing the recording sheets placed on the paper-feeding cassette 81 as well as on the manual paper-feeding cassette 82 to be fed via the transfer roller 10 and the fixing unit 7 to the paper catch tray 91. In the vicinity of the sheet conveyance path S ranging from the paper-feeding cassette 81 or the manual paper-feeding cassette 82 to the paper catch tray 91, there are arranged pick-up rollers 11*a* and 11*b*, a plurality of conveying rollers 12*a* through 12*d*, a registration roller 13, the transfer roller 10, the fixing unit 7, and so forth.

The conveying rollers 12*a* through 12*d* are a plurality of compact rollers arranged along the sheet conveyance path S, for facilitating and assisting the conveyance of the recording sheets. Moreover, the pick-up roller 11*a* is disposed in the vicinity of the end of the paper-feeding cassette 81, for picking up the recording sheets one by one from the paper-feeding cassette 81 and feeds them to the sheet conveyance path S. Likewise, the pick-up roller 11*b* is disposed in the vicinity of the end of the manual paper-feeding cassette 82, for picking up the recording sheets one by one from the manual paper-feeding cassette 82 and feeds them to the sheet conveyance path S.

Further, the registration roller 13 temporarily holds the recording sheet in the process of being conveyed along the sheet conveyance path S. The registration roller 13 has the capability of conveying the recording sheet to the transfer roller 10 in a timed relationship such that a leading end of the toner image borne on the photoreceptor drum 3 is aligned with a leading end of the recording sheet.

Thus, in the image forming apparatus 100 are disposed the paper-feeding cassette 81 for storing the recording sheets in advance and the manual paper-feeding cassette 82. In order to supply the recording sheets from these paper-feeding cassettes 81 and 82, the pick-up rollers 11*a* and 11*b* are arranged to direct the recording sheets one by one to the sheet conveyance path S.

The recording sheet conveyed from each of the paper-feeding cassettes 81 and 82 is conveyed by the conveying roller 12*a* of the sheet conveyance path S to the registration roller 13, and is then conveyed to the transfer roller 10 in a timed relationship such that the leading end of the recording sheet is aligned with the leading end of the image-data object borne on the intermediate transfer belt 61, whereupon the image data is committed onto the recording sheet. After that, during the passage of the recording sheet through the fixing unit 7, the yet-to-be fixed toner borne on the recording sheet is molten under application of heat and then fixed to the recording sheet, and eventually the recording sheet is discharged, through the conveying roller 12*b* located posteriorly of the fixing unit 7, onto the paper catch tray 91.

The sheet conveyance path mentioned above is adapted for a print-job request of single-sided printing on the recording sheet. On the other hand, in order to deal with a print-job request of double-sided printing, after the single-sided printing is completed and the tail end of the recording sheet that has passed through the fixing unit 7 is caught hold of by the last conveying roller 12*b*, the conveying roller 12*b* is rotated in a reverse direction so as to direct the recording sheet to the conveying rollers 12*c* and 12*d*. Then, after the recording sheet passes through the registration roller 13 and the back side of the recording sheet is subjected to printing process, the recording sheet is discharged onto the paper catch tray 91.

The fixing unit 7 comprises the heat roller 71 acting as a fixing roller and the pressure roller 72. The heat roller 71 and the pressure roller 72 are rotated, with the recording sheet lying therebetween. Moreover, the heat roller 71 is so designed that the temperature of its outer peripheral surface can be adjusted to a predetermined fixing temperature, based on a signal from a temperature detector 74, by an apparatus control section 118 as shown in FIG. 8 that will hereafter be described. The heat roller 71 has a function of pressing the toner onto the recording sheet under application of heat in cooperation with the pressure roller 72, thereby melting, mixing and pressing the toner images of multiple colors transferred onto the recording sheet and eventually causing it to be thermally fixed onto the recording sheet. In addition, an external heating belt 73 is disposed to heat the heat roller 71 from outside.

Figure 2:
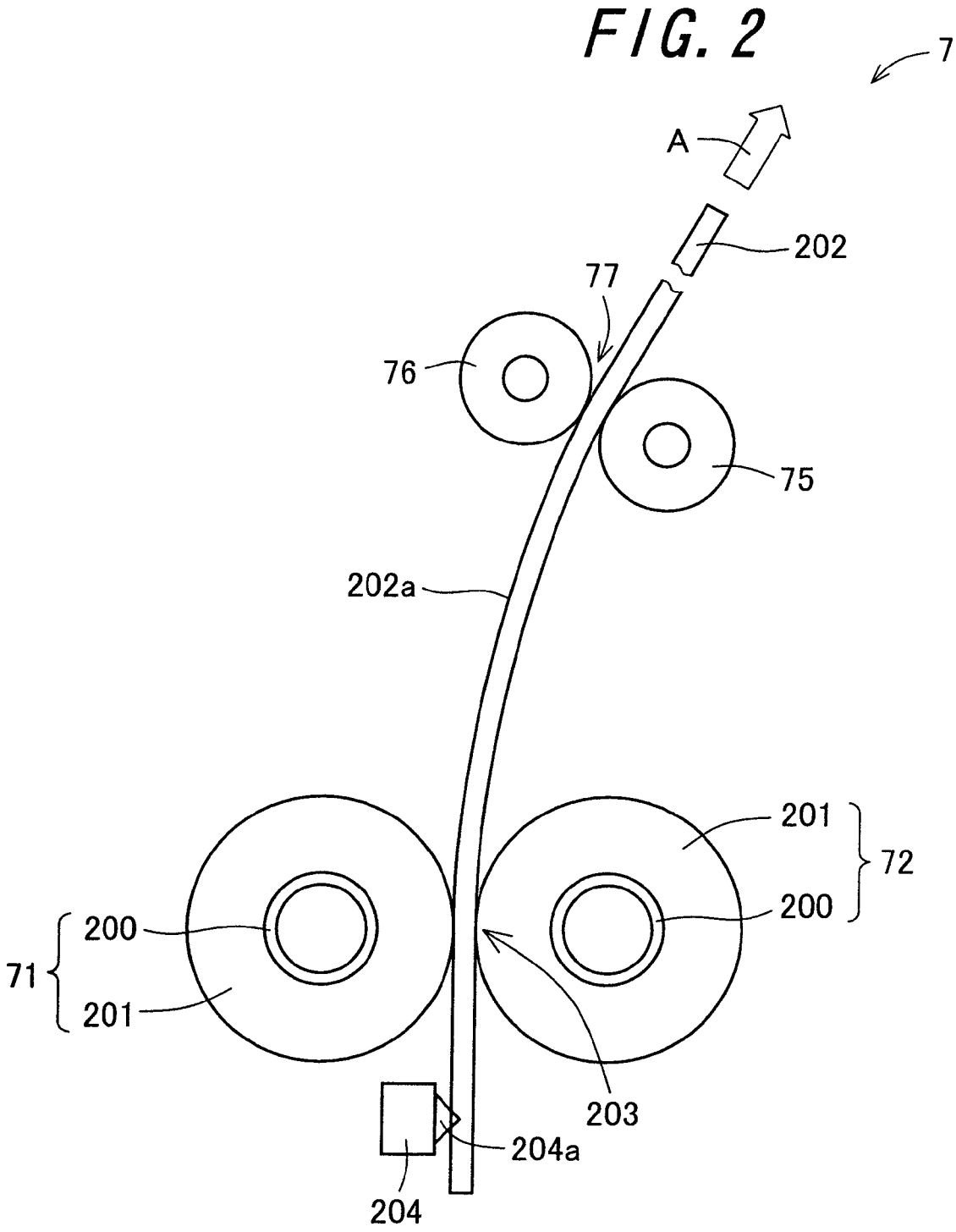
FIG. 2 is a schematic diagram showing the structure of the fixing unit in a simplified manner.

FIG. 2 is a schematic diagram showing the structure of the fixing unit 7 in a simplified manner. In order to simplify an understanding of the invention, in FIG. 2, the external heating belt 73 and the temperature detector 74 shown in FIG. 1 are omitted. The heat roller 71 and the pressure roller 72 are each realized by using an elastic roller. Each of the heat roller 71 and the pressure roller 72 has a cylindrically-shaped roller main body 201 and a cylindrically-shaped journal 200 which is so formed as to extend from both axial ends of the roller main body 201, the outer diameter of which is smaller than that of the roller main body 201. The roller main body 201, although not shown in the drawing, comprises a cylindrically-shaped core metal, an elastic layer with which the core metal is covered externally in a radial direction thereof, and a release layer with which the elastic layer is covered externally in the radial direction thereof. For example, the core metal is 5 mm in outer diameter size, the elastic layer is 5 mm in thickness dimension, and the release layer is 30 μm in thickness dimension.

Being constructed of elastic rollers, the heat roller 71 and the pressure roller 72 undergo elastic deformation at their surfaces when brought into pressure-contact with each other. The recording sheet 202 is retained in the nip region 203 where the heat roller 71 and the pressure roller 72 abut against each other, and is conveyed as the heat roller 71 and the pressure roller 72 are rotated. The recording sheet 202 is fed in such a manner that its toner image-bearing surface, namely image surface 202*a* on which the toner image is transferred by the transfer roller 10 can be brought into contact with the heat roller 71.

In order to convey the recording sheet 202 that has passed through the nip region 203, the fixing unit 7 has a post-fixing roller 75 and a post-fixing driven roller element 76 which moves depending on the rotation of the post-fixing roller 75 that are located downstream from the nip region 203 in the recording-sheet 202 conveyance direction A. The post-fixing roller 75 and the post-fixing driven roller element 76 are rotated with the recording sheet 202 caught in the space between them, whereby the recording sheet 202 can be conveyed. In order to simplify an understanding of the invention, in FIG. 2, the conveyance direction A in which the recording sheet 202 is conveyed after passing through an abutment region 77 where the post-fixing roller 75 and the post-fixing driven roller element 76 abut against each other is illustrated as tilting to the right viewing the drawing.

The fixing unit 7 further comprises a detecting section 204 acting as a detecting section. The detecting section 204 is disposed in front of the nip region 203 of the fixing unit 7; that is, located upstream of the nip region 203 in the recording-sheet 202 conveyance direction A. The detecting section 204 detects the recording sheet 202, to be more specific, the leading end of the recording sheet 202 i.e. the downstream-side end of the recording sheet 202 in the conveyance direction A. The detecting section 204 is realized by using an ON/OFF sensor. Upon a lever 204*a* being pressed by the recording sheet 202, an ON state is established, more specifically, the passage of the recording sheet 202 through a location opposed to the detecting section 204 is detected by the detecting section 204.

Figure 3:
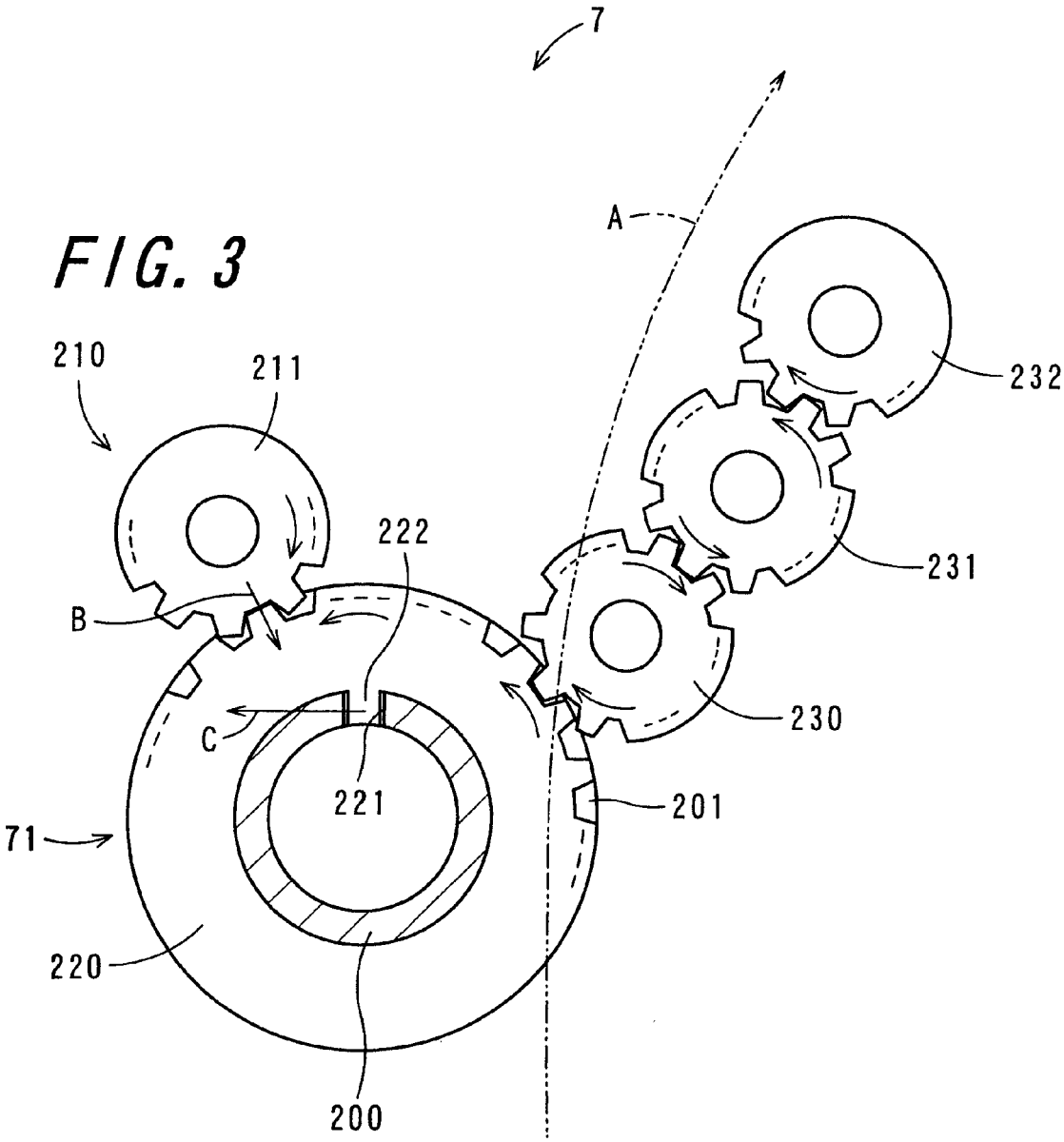
FIG. 3 is a view for explaining a mechanism for transmitting a driving force to a heat roller and to a post-fixing roller.

FIG. 3 is a view for explaining a mechanism for transmitting a driving force to the heat roller 71 and to the post-fixing roller 75. The heat roller 71 and the post-fixing roller 75 are rotated by a driving section 210. In order to rotate the heat roller 71 and the post-fixing roller 75, as shown in FIG. 3, in the driving section 210, a paper discharge unit-side gear 211, which is a driving gear wheel, is rotated by a non-illustrated motor, thus causing a fixing roller driving gear 220, which is a gear wheel of the fixing roller, to rotate. In order to simplify an understanding of the invention, in FIG. 3, the journal 200 of the heat roller 71 is cross-hatched, and part of the teeth of the gears 211, 220, 230, 231, and 232 is omitted.

Figure 4:
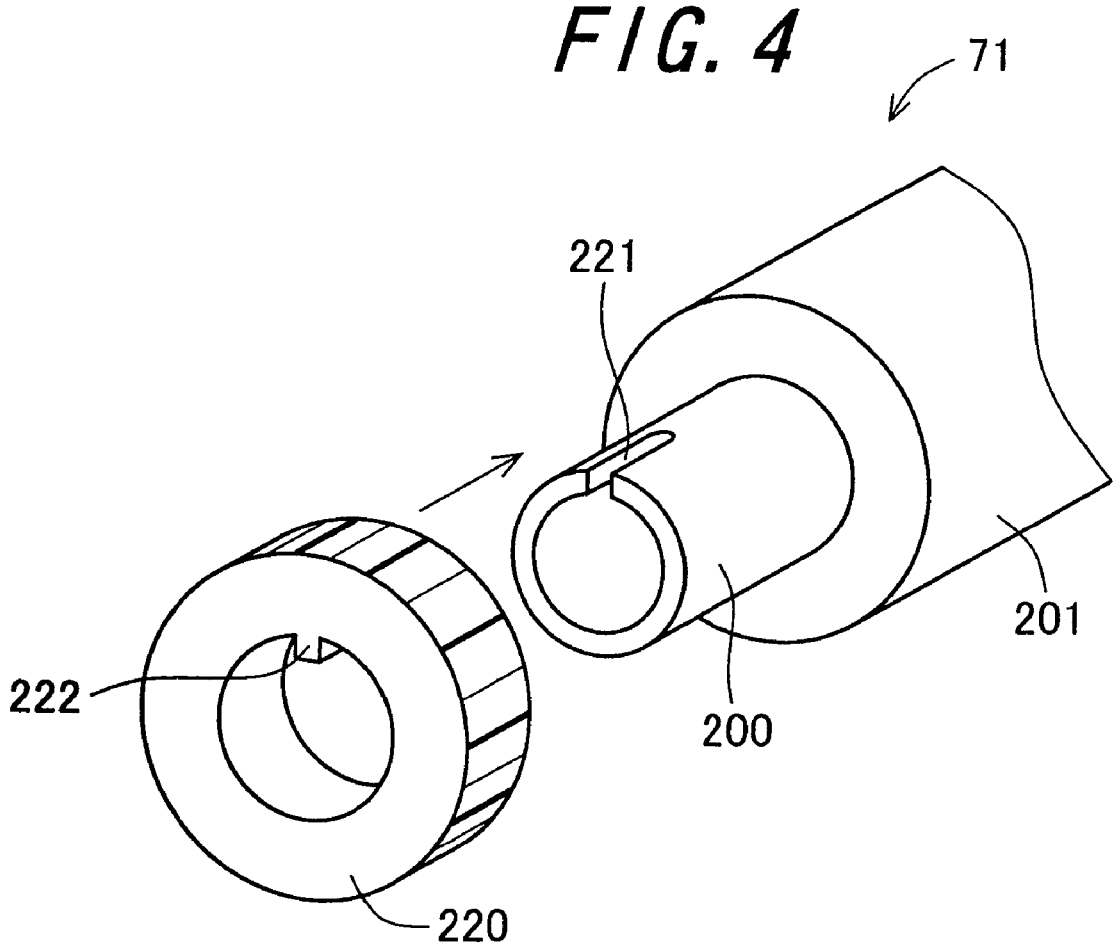
FIG. 4 is an exploded perspective view showing the heat roller in a disassembled state.
Figure 5:
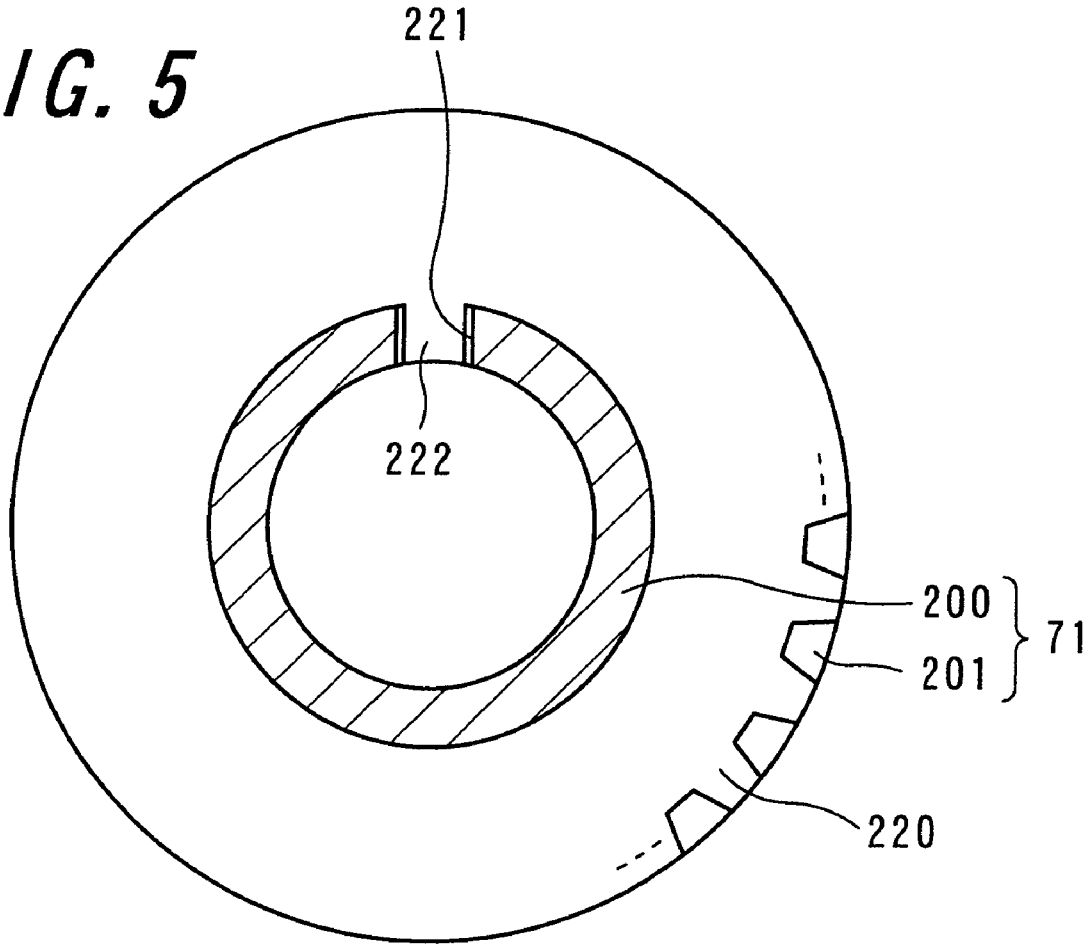
FIG. 5 is a side view of the heat roller, as viewed from one side in a direction axially thereof.

FIG. 4 is an exploded perspective view showing the heat roller 71 in a disassembled state. FIG. 5 is a side view of the heat roller 71, as viewed from one side in a direction axially thereof. In FIG. 5, the journal 200 of the heat roller 71 is cross-hatched, and part of the teeth of the fixing roller driving gear 220 is omitted. As has already been described, the heat roller 71 includes the roller main body 201 and the journal 200, and in addition the fixing roller driving gear 220. The journal 200 located at axial one side of the heat roller 71 has a keyway 221 formed in the shape of a linear notch extending in parallel with the axis of the heat roller 71. The fixing roller driving gear 220, which is formed into a substantially cylindrical shape, has teeth formed on the outer peripheral surface thereof and a key 222 formed on the inner peripheral surface thereof. The key 222 is fitted to the keyway 221.

The fixing roller driving gear 220 and the journal 200 are coupled to each other by fitting the key 222 formed in the fixing roller driving gear 220 to the keyway 221 formed in the journal 200. The roller main body 201 is formed integrally with the journal 200 and is thus coupled to the fixing roller driving gear 220 via the journal 200. The driving force transmitted to the fixing roller driving gear 220 is transmitted therethrough to the journal 200 and the roller main body 201. Under the driving force, the heat roller 71 is driven to rotate about its axis. The pressure roller 72 shown in FIG. 2 is rotated depending on the rotation of the heat roller 71. At this time, the pressure roller 72 is rotated in a direction opposite to the rotational direction of the heat roller 71.

Returning to FIG. 3, the fixing roller driving gear 220 receives driving-force transmission in a direction indicated by an arrow B from the paper discharge unit-side gear 211, whereby the journal 200 receives driving-force transmission in a direction indicated by an arrow C, with the result that the heat roller 71 is rotated. The paper discharge unit-side gear 211 and the fixing roller driving gear 220 are driven to rotate in opposite directions. In this embodiment, the paper discharge unit-side gear 211 is driven to rotate in a clockwise direction, whereas the fixing roller driving gear 220 is driven to rotate in a counterclockwise direction. In this way, the heat roller 71 is driven to rotate in a counterclockwise direction.

The fixing roller driving gear 220 is coupled, via a first coupling gear 230 and a second coupling gear 231, to a post-fixing roller driving gear 232. The first coupling gear 230 is engaged with the fixing roller driving gear 220. The second coupling gear 231 is engaged with the first coupling gear 230. The post-fixing roller driving gear 232 is engaged with the second coupling gear 231. The post-fixing roller driving gear 232 is included in the post-fixing roller 75 shown in FIG. 2. The post-fixing roller 75, just like the heat roller 71, comprises a roller main body and a journal to which is coupled the post-fixing roller driving gear 232 as in the case of the fixing roller driving gear 220.

The post-fixing roller 75 is rotated under the driving force transmitted from the fixing roller driving gear 220, through the first coupling gear 230 and the second coupling gear 231, to the post-fixing roller driving gear 232. In this embodiment, since the fixing roller driving gear 220 is driven to rotate in a counterclockwise direction, it follows that the post-fixing roller driving gear 232 is driven to rotate in a clockwise direction. Thereby, the post-fixing roller 75 is driven to rotate in a clockwise direction. The post-fixing driven roller element 76 shown in FIG. 2 is rotated in a counterclockwise direction depending on the rotation of the post-fixing roller 75.

In a case where the recording sheet 202 is thin, such as so-called thin paper having a basis weight as small as 40 g/m$^2$ or below, for example, as shown in FIG. 3, the driving force exerted by the motor is transmitted in the direction of the arrow B from the paper discharge unit-side gear 211 to the fixing roller driving gear 220, and further in the direction of the arrow C from the fixing roller driving gear 220 to the journal 200 of the fixing roller 71. That is, power is transmitted from the paper discharge unit-side gear 211 to the fixing roller driving gear 220, and the power sets upon the heat roller 71 to rotate it. In this way, so long as the direction of power transmission is from the paper discharge unit-side gear 211, through the fixing roller driving gear 220, to the journal 200 of the fixing roller 71, the condition of conveyance of the recording sheet 202 will hereafter be referred to as "normal recording-sheet conveyance condition".

On the other hand, in a case where the recording sheet is of the type that has a basis weight of 100 g/m$^2$ or above and has a certain thickness, such as gloss paper or heavy paper, the direction of power transmission indicated by the arrows B and C in FIG. 3 is reversed.

Figure 6:
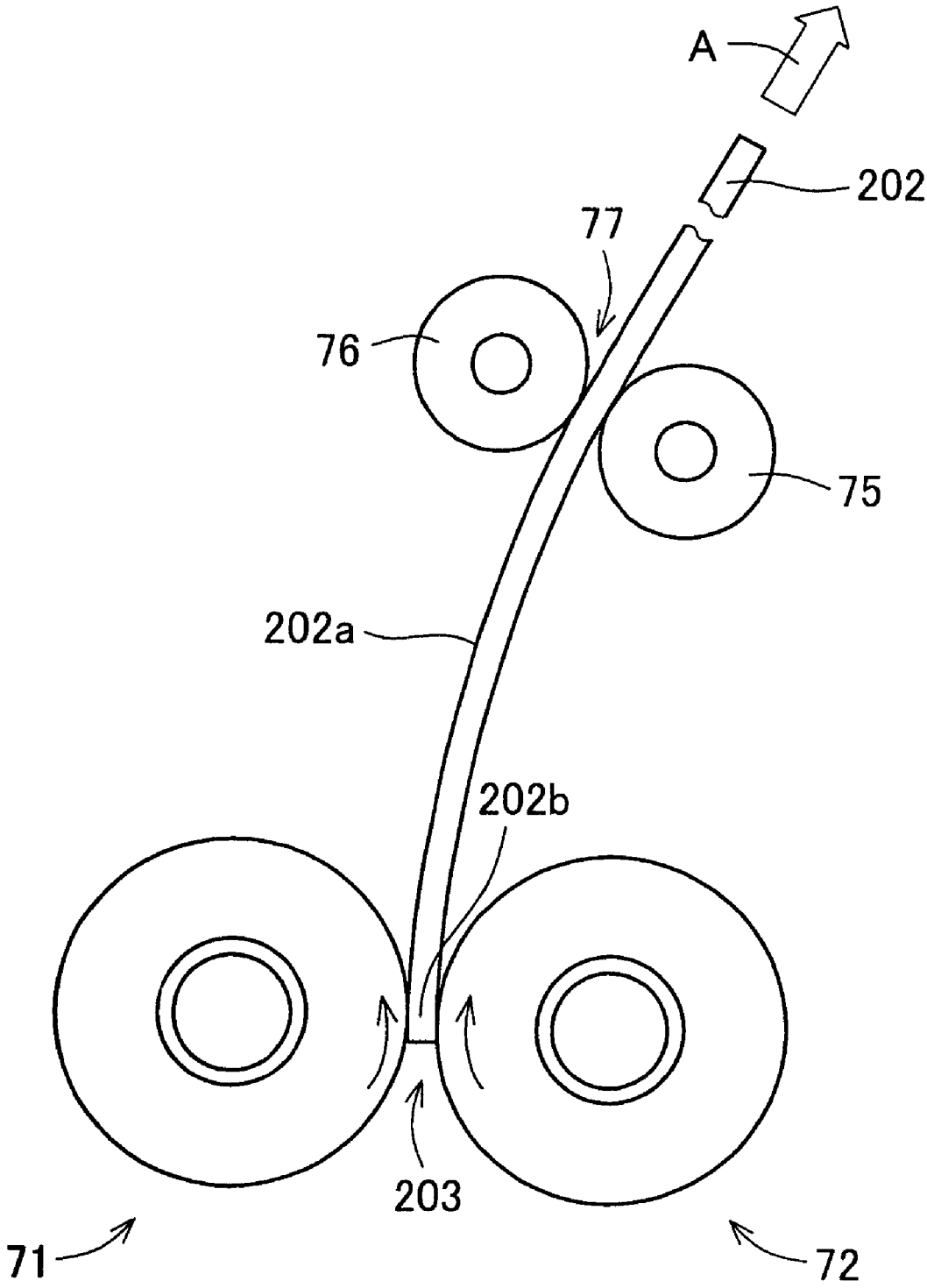
FIG. 6 is a view for explaining a mechanism for reversing a direction of power transmission.
Figure 7:
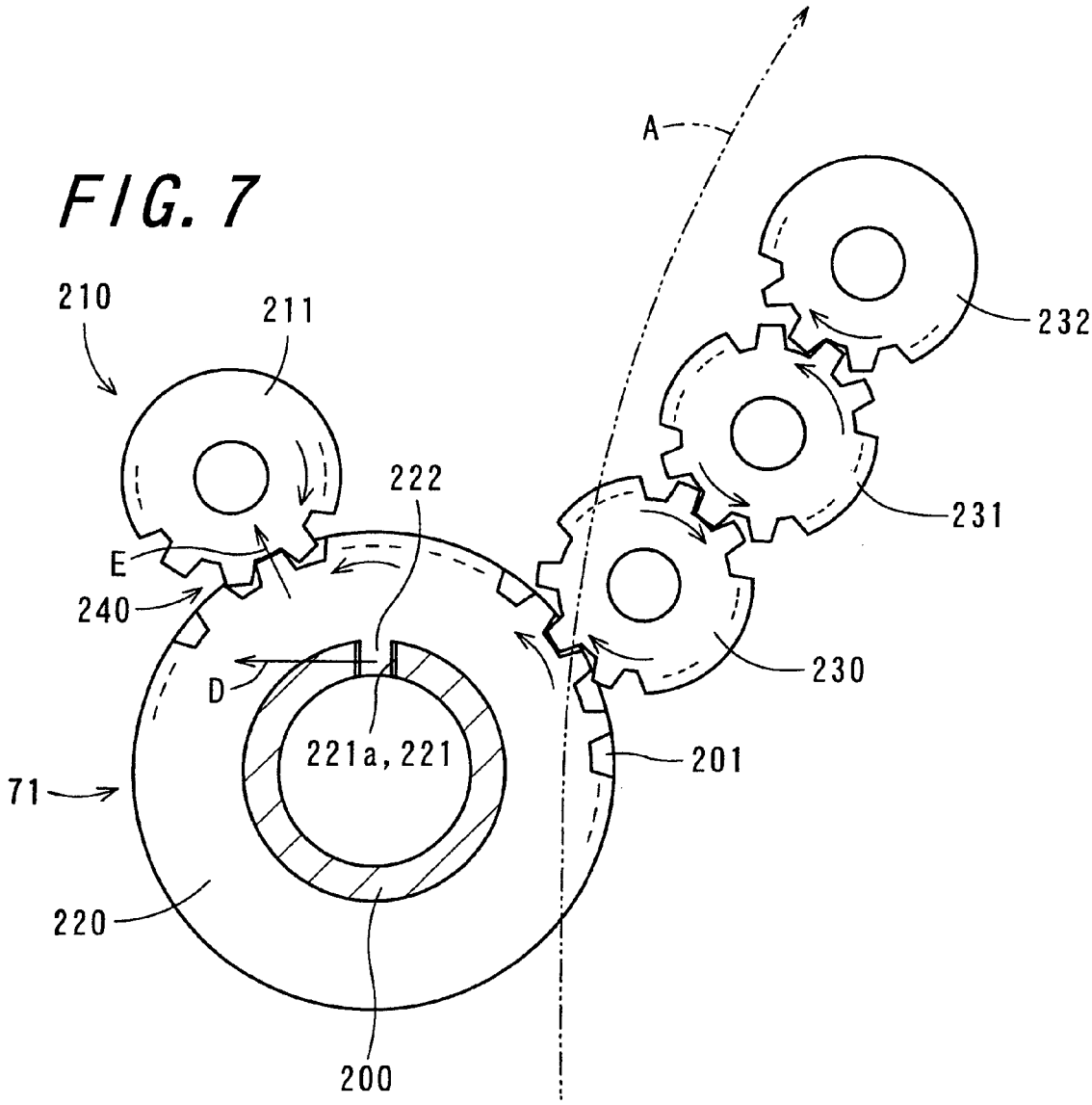
FIG. 7 is a view for explaining a mechanism for transmitting a driving force in a reversed power-transmission direction.

FIG. 6 is a view for explaining a mechanism for reversing the direction of power transmission. FIG. 7 is a view for explaining a mechanism for transmitting a driving force in a case where the power transmission direction is reversed. In order to simplify an understanding of the invention, in FIG. 7, the journal 200 of the heat roller 71 is cross-hatched, and part of the teeth of the gears 211, 220, 230, 231, and 232 is omitted. As has already been described, since the heat roller 71 and the pressure roller 72 are each an elastic roller, when the recording sheet 202 passes through the nip region 203, the heat roller 71 and the pressure roller 72 undergo elastic deformation owing to the recording sheet 202, in consequence whereof there results a buildup of elastic energy in the rollers 71 and 72. The accumulated elastic energy is released when the recording sheet 202 comes out of the nip region 203; that is, when the upstream-side end 202*b* of the recording sheet 202 in the conveyance direction A passes through the nip region 203, thus causing speeding up of both rollers, namely the heat roller 71 and the pressure roller 72.

At this time, as shown in FIG. 7, the key 222 of the fixing roller driving gear 220 is subjected to a force in, among regions of the journal 200 of the heat roller 71 which defines the keyway 221, a region 221*a* kept in contact with the key 222 with respect to the upstream side in the direction in which the heat roller 71 is rotated. This leads to variation in the drive load on the heat roller 71. Under the pressure applied to the key 222, the power transmission direction is reversed, thus effecting power transmission in a direction indicated by an arrow D from the journal 200 of the heat roller 71 to the fixing roller driving gear 220. In consequence, the fixing roller driving gear 220 is rotated, and thereby power transmission is effected in a direction indicated by an arrow E from the fixing roller driving gear 220 to the paper discharge unit-side gear 211. That is, with the speeding up of the heat roller 71, the power transmission direction is a direction from the heat roller 71, through the fixing roller driving gear 220, to the paper discharge unit-side gear 211.

The paper discharge unit-side gear 211, which is rotatably driven by a motor, is designed to effect power transmission in a direction reverse to the direction of the arrow E, namely in the power transmission direction of the arrow B shown in FIG. 3. Therefore, tooth jumping occurs between the fixing roller driving gear 220 and the paper discharge unit-side gear 211, more specifically, in an engagement part indicated by a reference numeral 240 where the fixing roller driving gear 220 and the paper discharge unit-side gear 211 engage with each other.

Until such time that the normal recording-sheet conveyance condition returns following the completion of speeding up of the heat roller 71 and re-engagement between the paper discharge unit-side gear 211 and the fixing roller driving gear 220, as shown in FIG. 6, the recording sheet 202 is standing still, with its upstream-side end 202*b* in the recording-sheet 202 conveyance direction A kept at the nip region 203. That is, the recording sheet 202 comes to a temporary halt upon the upstream-side end 202*b* thereof in the recording-sheet 202 conveyance direction A reaching the nip region 203. During the halting of the recording sheet 202, the post-fixing driven roller element 76 is kept in contact with the image surface 202*a* of the recording sheet 202. Inconveniently, the post-fixing driven roller element 76 leaves some impressions on the image borne on the image surface 202*a*.

Hence, in this embodiment, by operating the driving section 210 under the control of an apparatus control section 118 in a manner as will hereafter be described, it is possible to prevent occurrence of tooth jumping between the fixing roller driving gear 220 and the paper discharge unit-side gear 211, and thereby prevent the conveyance of the recording sheet 202 from being impeded.

FIG. 8 is a block diagram showing the electrical configuration of the image forming apparatus 100 according to the embodiment. The image forming apparatus 100 of this embodiment is built as a digital multifunctional peripheral. In the digital multifunctional peripheral 100, several different modes can be established in a selective manner, such as a copier mode in which an image of a document is read and recorded on a recording sheet, a printer mode in which an image received from an external terminal apparatus 500 is recorded on a recording sheet; a scanner mode in which an image of a document is read and transmitted to the external terminal apparatus 500; and a facsimile mode in which an image of a document is read and transmitted, and an image of a document is received and printed onto a recording sheet. For example, the external terminal apparatus 500 includes a network terminal unit 501, a facsimile device 502, an Internet facsimile device 503, and an external personal computer (PC for short) 504.

The digital multifunctional peripheral 100 comprises an image reading section 90, an operation section 114, an image forming section 116, an apparatus control section 118, a communication section 101, a HD (hard disk) device 121, a management section 141, an image processing section 119, an erasure section 122, a sound section 123, and a facsimile modem (hereafter referred to as "FAX modem") 124. The image forming section 116 includes the printing section 117 shown in FIG. 1, a memory 116*a*, and an encryption-decryption portion 116*b*. The image reading section 90 includes a CCD (Charge Coupled Device) image sensor 112*a*, a document detection sensor 112*b*, and a signal generating circuit 112*c*. The digital multifunctional peripheral 100 is connected to the network terminal unit 501 via a local area network 510, is connected to the Internet facsimile device 503 and the external PC 504 via the local area network 510 and an Internet network 512, and is connected to the external facsimile device 502 via the FAX modem 124 and a telephone network 511.

In the digital multifunctional peripheral 100 thereby constructed, the apparatus control section 118 exercises overall control, and more specifically controls the image reading section 90, the image forming section 116, the communication section 101, and so forth while monitoring instructions inputted through the operation of an input portion 114*a*, which is realized by using a tablet or key, of the operation section 114 as well as instructions inputted from the external terminal apparatus 500 via the communication section 101, and enabling one of various modes appropriately in response to the inputted instructions. Moreover, at the time of enabling the mode, the apparatus control section 118 effects control of the operation section 114 in a manner so as to display information, such as information about the conditions of the digital multifunctional peripheral 100 and information to be furnished to users, on a display portion 114*b* properly. The management section 141 keeps information about the components to be controlled by the apparatus control section 118. On the basis of such pieces of information, the apparatus control section 118 exercises control over the workings of the digital multifunctional peripheral 100 as a whole. The apparatus control section 118 functions as a control section for controlling the driving section 210 of the fixing unit 7. Further, the apparatus control section 118 functions also as a clock section for reckoning the length of time that has elapsed since the recording-sheet 202 detection by the detecting section 204.

Figure 9:
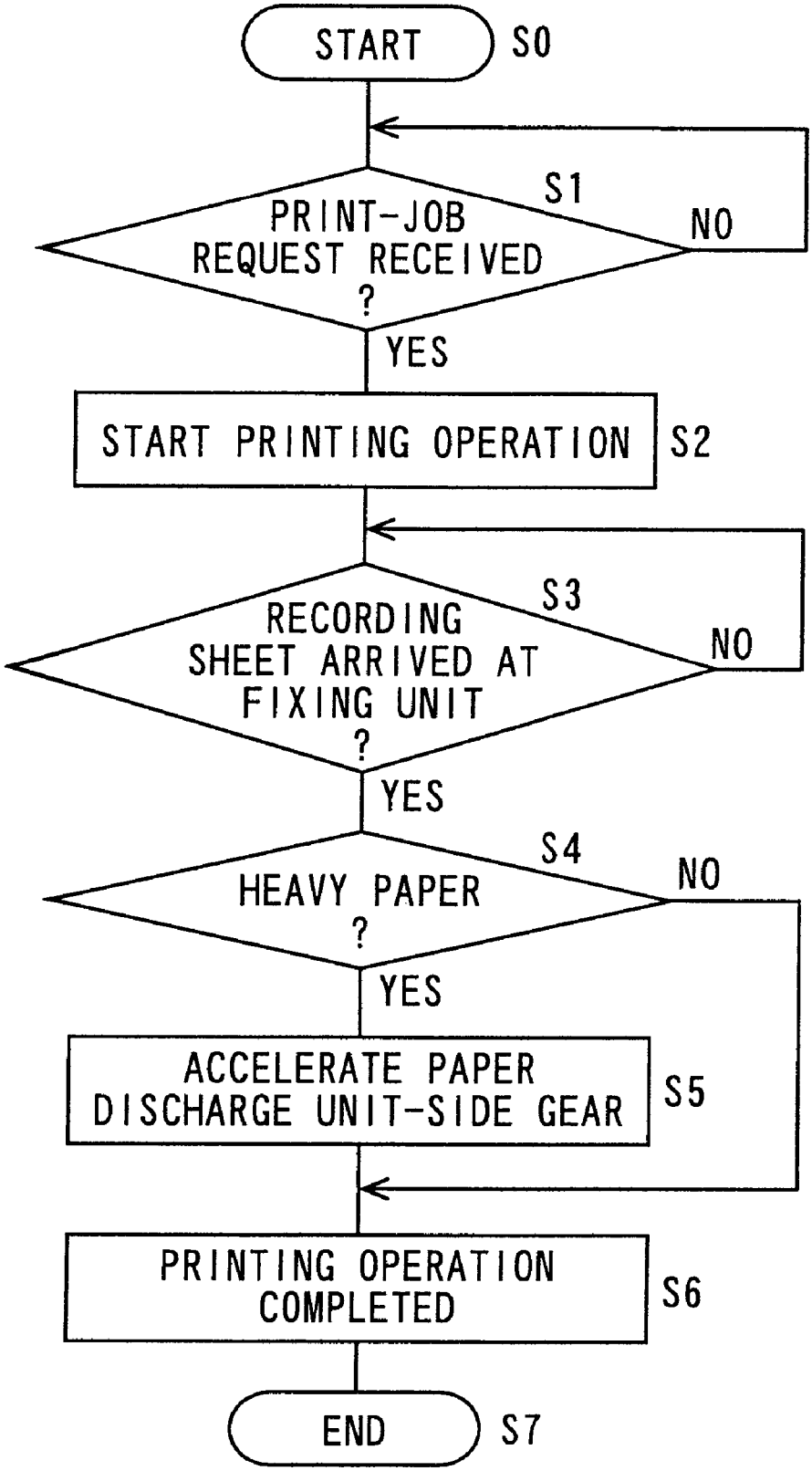
FIG. 9 is a flow chart showing procedural steps for the operation of an apparatus control section.

FIG. 9 is a flow chart showing procedural steps for the operation of the apparatus control section 118. Upon turning on the power of the image forming apparatus 100 built as a digital multifunctional peripheral, the apparatus control section 118 starts operation at Step S0, and the procedure proceeds to Step S1.

In Step S1, the apparatus control section 118 determines whether a print-job request has been issued or not. When it is determined that a print-job request has been issued, the procedure proceeds to Step S2, The judgment as to the presence or absence of a print-job request in Step S1 is continued until the presence of a print-job request is determined. That is, the apparatus control section 118 is kept in a standby state until a print-job request is issued. In Step S2, the apparatus control section 118 starts printing process, and the procedure proceeds to Step S3. In Step S3, the apparatus control section 118 determines whether the recording sheet 202 has reached the fixing unit 7 or not, and more specifically determines whether the recording sheet 202 has been detected by the detecting section 204 or not. When it is determined that the recording sheet 202 has been detected by the detecting section 204; that is, the recording sheet 202 has reached the fixing unit 7, then the procedure proceeds to Step S4. When it is determined that the recording sheet 202 has not been detected by the detecting section 204; that is, the recording sheet 202 has not reached the fixing unit. 7, then the procedure returns to Step S3.

In Step S4, the apparatus control section 118 determines whether or not the thickness dimension of the recording sheet 202 is greater than or equal to a predetermined acceleration-adapted thickness dimension. When the thickness dimension is determined to be greater than or equal to the acceleration-adapted thickness dimension, the procedure proceeds to Step S5. When the thickness dimension is determined to be neither greater than nor equal to the acceleration-adapted thickness dimension; that is, determined to be less than the acceleration-adapted thickness dimension, the procedure proceeds to Step S6. In step 5 that will hereafter be described, a state where the thickness dimension of the recording sheet 202 is greater than or equal to the acceleration-adapted thickness dimension is one of conditions for acceleration, namely conditions for increasing the rotating speed of the paper discharge unit-side gear 211.

In this embodiment, the acceleration-adapted thickness dimension is so selected as to be the thickness dimension of heavy paper. The thickness dimension of the recording sheet 202 is represented as the weight of the recording sheet 202 per square meter ($m^2$), and "heavy paper" refers to a recording sheet having a basis weight of 100 $g/m^2$ or above. That is, the apparatus control section 118 determines in Step S4 whether the recording sheet 202 is heavy paper or not. When it is determined that the recording sheet 202 is heavy paper, the procedure proceeds to Step S5. When it is determined that the recording sheet 202 is not heavy paper, the procedure proceeds to Step S6.

In order to determine whether the recording sheet 202 is heavy paper or not, there is the following approach: when the recording sheet 202 is placed in the paper-feeding cassette or an instruction on the startup of image forming operation is given by the user, the type of paper, for example, whether heavy paper or thin paper, is registered in advance. However, since there is no particular limitation, it is also possible to provide a sensor at a location along the sheet conveyance path for measurement of the thickness dimension of the recording sheet 202. In this case, the thickness dimesion of the recording sheet 202 is given not in terms of basis weight but in terms of actual measurement value. As the sensor, an ultrasonic sensor can be used, for example. In the case of disposing the ultrasonic sensor, as a plural-sheet feeding detection sensor for detecting feeding of a plurality of recording sheets 202 in a stack, at a location along the sheet conveyance path, the plural-sheet feeding detection sensor may be used to measure the thickness dimension of the recording sheet 202. For example, the plural-sheet feeding detection sensor is mounted in an image forming apparatus for performing image formation at high speed, namely, a so-called high speed machine.

In Step S5, in exact timing with the insertion of the tail end, namely the upstream-side end 202*b* of the recording sheet 202 in the conveyance direction A into the nip region 203, the apparatus control section 118 controls the paper discharge unit-side gear 211 so that it undergoes acceleration after a lapse of a predetermined waiting time for acceleration from a point of time when the recording sheet 202 was detected by the detecting section 204, and also controls the paper discharge unit-side gear 211 so that it is rotated at a rotating speed higher than a before-acceleration rotating speed over a predetermined high-speed rotating period. The waiting time for acceleration, which is the length of time that has elapsed since the recording-sheet 202 detection, is so selected as to be a predicted value of the time taken for the tail end of the recording sheet 202 to reach the nip region 203. That is, after determining that the positional relationship between the nip region 203 and the recording sheet 202 shown in FIG. 2 conforms to a predetermined acceleration-adapted positional relationship, namely, in this embodiment, the recording sheet 202-to-nip region 203 positional relationship established at the point of time when the tail end of the recording sheet 202 has reached the nip region 203, the apparatus control section 118 effects speeding up of the paper discharge unit-side gear 211. A state where the nip region 203 and the recording sheet 202 assume the predetermined acceleration-adapted positional relationship is one of the conditions for acceleration to increase the rotating speed of the paper discharge unit-side gear 211.

After the paper discharge unit-side gear 211 is rotated under the acceleration state in that way, the procedure proceeds to Step S6 where the recording sheet 202 that has passed through the fixing unit 7 is ejected onto the paper catch tray 91, and-the printing operation is completed. Then, the procedure proceeds to Step S7 where the procedure comes to an end. The process steps in Steps S1 through S6 are executed repeatedly during the interval when the image forming apparatus 100 is kept in a power-on state.

In Step S5, the high-speed rotating period, which is the duration of time that the paper discharge unit-side gear 211 is rotated at a rotating speed higher than the before-acceleration rotating speed, is so selected as to be a predicted value of the time taken for the tail end of the recording sheet 202 to pass through the entire nip region 203. That is, the apparatus control section 118 controls the rotating speed of the paper discharge unit-side gear 211 so that it can be higher than the rotating speed set for the normal recording-sheet conveyance condition over the time taken for the tail end of the recording sheet 202 to pass through the entire nip region 203.

Figure 10:
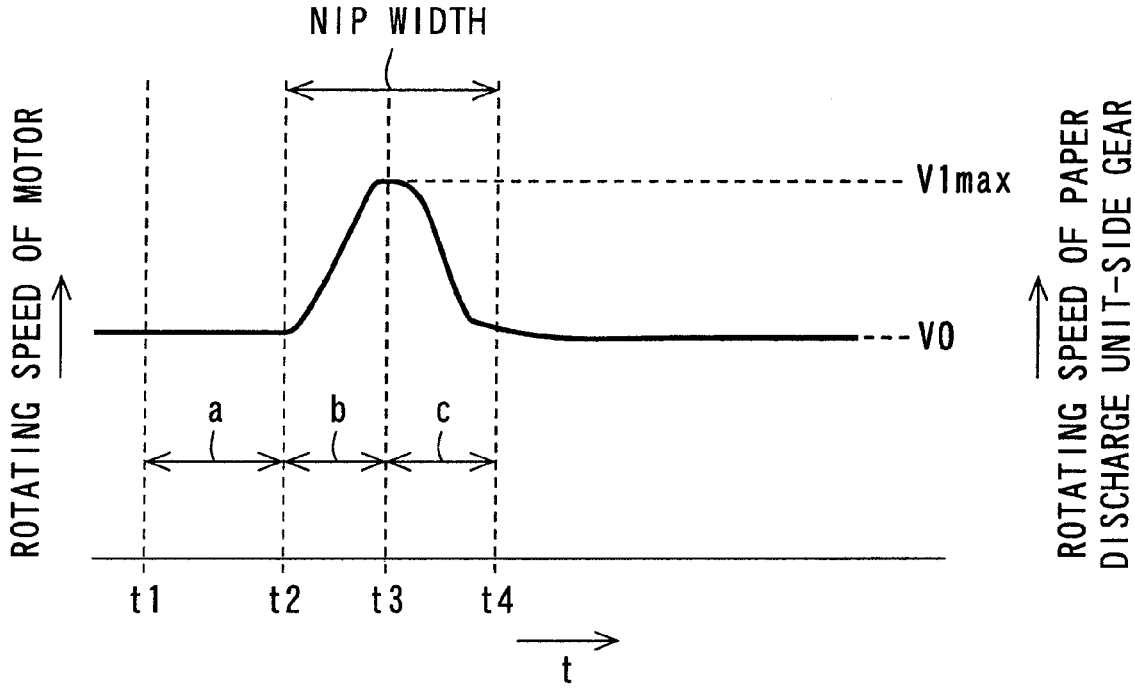
FIG. 10 is a timing chart showing rotating speeds of, respectively, a paper discharge unit-side gear and a motor for rotating the paper discharge unit-side gear over time.

FIG. 10 is a timing chart showing the rotating speeds of, respectively, the paper discharge unit-side gear 211 and a motor for rotating the paper discharge unit-side gear 211 over time. Upon the recording sheet 202 being detected by the detecting section 204 at a point of time t1, then the apparatus control section 118 starts to reckon the length of time that has elapsed since the recording-sheet 202 detection by the detecting section 204. At a point of time t2 when the waiting time for acceleration a has elapsed from the point of time t1 when the recording sheet 202 was detected by the detecting section 204, the rotating speed of the motor is increased, and the speeding up of the paper discharge unit-side gear 211 is effected correspondingly.

At a point of time t3 when a predetermined acceleration time b has elapsed from the point of time t2 when the speeding up of the motor was effected, the rotating speed of the motor is decreased, and the slowing down of the paper discharge unit-side gear 211 is effected correspondingly. At a point of time t4 when a predetermined deceleration time c has elapsed from the point of time t3 when the slowing down of the paper discharge unit-side gear 211 was effected, the slowing down of the paper discharge unit-side gear 211 is stopped.

In this embodiment, the slowing down of the paper discharge unit-side gear 211 is effected in such a manner that the rotating speed of the paper discharge unit-side gear 211 can be returned to the rotating speed thereof set for the normal recording-sheet conveyance condition at the point of time t4. That is, in this embodiment, the sum of the acceleration time b and the deceleration time c is the high-speed rotating period, which is the duration of time that the paper discharge unit-side gear 211 is rotated at a rotating speed higher than the rotating speed thereof set for the normal recording-sheet conveyance condition. The sum of the acceleration time b and the deceleration time c obtained as the high-speed rotating period is, in this embodiment, so selected as to be a predicted value of the time taken for the tail end of the recording sheet 202 to pass through the entire nip region 203. Accordingly, the point of time t4 corresponds to a point of time when the tail end of the recording sheet 202 passes through the downstream-side end of the nip region 203 in the recording-sheet 202 conveyance direction.

A maximum value V1max of the rotating speed V1 of the paper discharge unit-side gear 211 in the high-speed rotating period (hereafter referred to as "maximum rotating speed") is so selected as to be 20 to 30 percent ahead of the before-acceleration rotating speed, namely the rotating speed V0 of the paper discharge unit-side gear 211 set for the normal recording-sheet conveyance condition. That is, the maximum rotating speed V1max of the paper discharge unit-side gear 211 in the high-speed rotating period is so selected as to be 1.2 times or above but 1.3 times or below the before-acceleration rotating speed V0.

Moreover, in this embodiment, the acceleration time b and the deceleration time c are so selected as to be equal. That is, the acceleration time b and the deceleration time c are each set to half the predicted value of the time taken for the tail end of the recording sheet 202 to pass through the entire nip region 203. Accordingly, the point of time t3 when the acceleration time b has elapsed from the point of time t2 when the speeding up of the paper discharge unit-side gear 211 was effected conforms to a point of time when the tail end 202*b* of the recording sheet 202 passes through a midportion between both ends of the nip region 203 in the recording-sheet 202 conveyance direction A. At the point of time t3, the rotating speed of the paper discharge unit-side gear 211 reaches a peak. That is, the apparatus control section 118 controls the driving section 210 to adjust the rotating speed of the motor in such a manner that the paper discharge unit-side gear 211 peaks in rotating speed at the point of time t3; that is, the rotating speed V1 of the paper discharge unit-side gear 211 rises to a maximum at the point of time t3 when the recording sheet 202 passes through the midportion of the nip region 203.

The waiting time for acceleration a can be derived from the distance between the detecting section 204 and the upstream-side end of the nip region 203 in the recording-sheet 202 conveyance direction A (hereafter referred to as "distance between the detecting section 204 and the nip region 203") and the dimension of the recording sheet 202 in the conveyance direction A. To be specific, on the basis of the distance between the detecting section 204 and the nip region 203, a predicted value of the time which has elapsed between the recording-sheet 202 detection by the detecting section 204 and the arrival at the nip region 203 of the leading end of the recording sheet 202 (hereafter referred to as "time of front-end arrival at the nip") is obtained. Moreover, on the basis of the dimension of the recording sheet 202 in the conveyance direction A, a predicted value of the time which has elapsed between the arrival at the nip region 203 of the leading end of the recording sheet 202 and the arrival at the nip region 203 of the tail end 202*b* of the recording sheet 202 (hereafter referred to as "time of tail-end arrival at the nip") is obtained. The sum of the predicted value of the time of front-end arrival at the nip and the predicted value of the time of tail-end arrival at the nip thereby obtained is a predicted value of the time which has elapsed between the recording-sheet 202 detection by the detecting section 204 and the arrival at the nip region 203 of the tail end 202*b* of the recording sheet 202, namely the waiting time for acceleration a.

As described heretofore, according to this embodiment, when it is determined by the apparatus control section 118 that the conditions for acceleration are fulfilled; that is, the positional relationship between the nip region 203 and the recording sheet 202 conforms to the acceleration-adapted positional relationship and the thickness dimension of the recording sheet 202 is greater than or equal to the acceleration-adapted thickness dimension, then the rotating speed of the paper discharge unit-side gear 211 is increased by the driving section 210 which is controlled by the apparatus control section 118. In this way, the paper discharge unit-side gear 211 is rotated at a rotating speed higher than the before-acceleration rotating speed over the high-speed rotating period.

The conditions for acceleration include the coincidence between the nip region 203-to-recording sheet 202 positional relationship and the acceleration-adapted positional relationship. Therefore, when the drive load on the heat roller 71 is caused to vary due to the interaction between the nip region 203 and the recording sheet 202, for example, when the heat roller 71 receives application of a force other than the driving force transmitted thereto from the driving section 210 via the fixing roller driving gear 220, the speeding up of the paper discharge unit-side gear 211 can be effected. This makes it possible to prevent occurrence of tooth jumping between the fixing roller driving gear 220 and the paper discharge unit-side gear 211, and thereby prevent the conveyance of the recording sheet 202 from being impeded. Accordingly, as in the case of this embodiment, by disposing the post-fixing driven roller element 76 downstream from the nip region 203 in the recording-sheet conveyance direction A, it is possible to protect the recording sheet 202 from impressions made by the post-fixing driven roller element 76.

Moreover, in this embodiment, the acceleration-adapted positional relationship is so selected as to be the recording sheet 202-to-nip region 203 positional relationship established at the point of time when the tail end 202*b* of the recording sheet 202, namely the upstream-side end of the recording sheet 202 in the conveyance direction A, has reached the nip region 203. In this way, upon the arrival at the nip region 203 of the tail end 202*b* of the recording sheet 202, the rotating speed of the paper discharge unit-side gear 211 can be increased by the driving section 210. Accordingly, when the tail end 202*b* of the recording sheet 202 passes through the nip region 203, the paper discharge unit-side gear 211 can be rotated at a rotating speed higher than the before-acceleration rotating speed. This makes it possible to prevent occurrence of tooth jumping between the fixing roller driving gear 220 and the paper discharge unit-side gear 211. Note that the acceleration-adapted positional relationship is not limited to the recording sheet 202-to-nip region 203 positional relationship established at the point of time when the tail end 202*b* of the recording sheet 202 has reached the nip region 203, but may be so selected as to be another positional relationship such that tooth jumping may occur between the fixing roller driving gear 220 and the paper discharge unit-side gear 211.

Moreover, in this embodiment, the high-speed rotating period is set to a predicted value of the time which has elapsed between the arrival at the nip region 203 of the tail end 202*b* of the recording sheet 202 and the completion of passage of the tail end 202*b* of the recording sheet 202 through the entire nip region 203. In this way, during the time the tail end 202*b* of the recording sheet 202 is expected to be passing through the nip region 203, the paper discharge unit-side gear 211 can be rotated at a rotating speed higher than that at which it is rotated before the tail end 202*b* of the recording sheet 202 reaches the nip region 203. Accordingly, occurrence of tooth jumping between the fixing roller driving gear 220 and the paper discharge unit-side gear 211 can be prevented more reliably, wherefore the conveyance of the recording sheet 202 can be prevented from being impeded more reliably.

Moreover, in this embodiment, as shown in FIG. 10, the apparatus control section 118 controls the driving section 210 to drive the motor in such a manner that, among the rotating speeds of the paper discharge unit-side gear 211 for the duration of the passage of the tail end 202*b* of the recording sheet 202 through the nip region 203, the rotating speed of the paper discharge unit-side gear 211 corresponding to the point of time when the tail end 202*b* of the recording sheet 202 passes through the midportion between both ends of the nip region 203 in the recording-sheet 202 conveyance direction A rises to a maximum. This makes it possible to prevent tooth jumping from occurring between the fixing roller driving gear 220 and the paper discharge unit-side gear 211 more reliably, and thereby prevent the conveyance of the recording sheet 202 from being impeded more reliably.

Moreover, in this embodiment, after determining that the tail end 202*b* of the recording sheet 202 has passed through the midportion between both ends of the nip region 203 in the recording-sheet 202 conveyance direction A, the apparatus control section 118 effects control of the driving section 210 in a manner so as to decrease the rotating speed of the paper discharge unit-side gear 211. In this way, as in the case of this embodiment, when the rotating speed of the paper discharge unit-side gear 211 is returned to the before-acceleration rotating speed following the passage of the tail end 202*b* of the recording sheet 202 through the nip region 203, it is possible to alleviate the change of the rotating speed of the paper discharge unit-side gear 211, and thereby achieve smooth conveyance of the recording sheet 202.

Moreover, in this embodiment, the maximum rotating speed V1max of the paper discharge unit-side gear 211 in the high-speed rotating period is so selected as to be 1.2 times or above but 1.3 times or below the before-acceleration rotating speed V0. Although the selection of the maximum rotating speed V1max of the paper discharge unit-side gear 211 in the high-speed rotating period is not limited to the aforementioned range, as in the case of this embodiment, it is preferable that the maximum rotating speed V1max is 1.2 times or above but 1.3 times or below the before-acceleration rotating speed V0. By setting the maximum rotating speed V1max of the paper discharge unit-side gear 211 in the high-speed rotating period to be 1.2 times or above but 1.3 times or below the before-acceleration rotating speed V0, it is possible to increase the rotating speed of the paper discharge unit-side gear 211 without causing abrupt speeding up and without inhibiting the rotating of the paper discharge unit-side gear 211.

Moreover, in this embodiment, when the length of time that has elapsed since the recording-sheet 202 detection by the detecting section 204 is found to be greater than or equal to the waiting time for acceleration, the apparatus control section 118 determines that the nip region 203-to-recording sheet 202 positional relationship conforms to the acceleration-adapted positional relationship. By selecting the waiting time for acceleration in an appropriate manner, it is possible to increase the rotating speed of the paper discharge unit-side gear 211 when a predetermined part of the recording sheet 202 reaches the nip region 203. Accordingly, occurrence of tooth jumping between the fixing roller driving gear 220 and the paper discharge unit-side gear 211 can be prevented more reliably, wherefore the conveyance of the recording sheet 202 can be prevented from being impeded more reliably.

In this embodiment, the waiting time for acceleration is so selected as to be a predicted value of the time which has elapsed between the recording-sheet 202 detection by the detecting section 204 and the arrival at the nip region 203 of the tail end 202*b* of the recording sheet 202. In this way, when it is expected that the tail end 202*b* of the recording sheet 202 has reached the nip region 203, the rotating speed of the paper discharge unit-side gear 211 can be increased by the driving section 210. Accordingly, occurrence of tooth jumping between the fixing roller driving gear 220 and the paper discharge unit-side gear 211 can be prevented more reliably.

As described heretofore, according to this embodiment, the apparatus control section 118 starts the speeding up of the paper discharge unit-side gear 211 at the point of time when the tail end 202*b* of the recording sheet 202 is expected to have reached the nip region 203, namely, at the point of time t2 when the length of time that has elapsed since the point of time t1 when the recording sheet 202 was detected by the detecting section 204 conforms to the waiting time for acceleration a, and then starts the slowing down of the paper discharge unit-side gear 211 at the point of time t3 when the length of time that has elapsed since the point of time t2 conforms to the predicted value b of the time which has elapsed between the starting of the speeding up and the moment at which the recording sheet 202 has passed through the midportion of the nip region 203. In this way, the speeding up of the paper discharge unit-side gear 211 is effected in proper timed relation with respect to the length of time that has elapsed since the recording-sheet 202 detection by the detecting section 204, wherefore the timing of the speeding up of the paper discharge unit-side gear 211 can be adjusted with ease. By way of another embodiment of the invention, a sensor may be provided to actually detect the position of the tail end 202*b* of the recording sheet 202. Also in this case, the speeding up of the paper discharge unit-side gear 211 can be timed properly.

Moreover, in this embodiment, the conditions for acceleration include a condition that the thickness dimension of the recording medium is greater than or equal to the acceleration-adapted thickness dimension. That is, after determining that the thickness dimension of the recording sheet 202 is greater than or equal to the acceleration-adapted thickness dimension, the apparatus control section 118 effects control of the driving section 210 in a manner so as to increase the rotating speed of the paper discharge unit-side gear 211. In this way, in a case where the thickness dimension of the recording sheet 202 is greater than or equal to the acceleration-adapted thickness dimension, for example, where the recording sheet 202 is heavy paper or gloss paper productive of tooth jumping between the fixing roller driving gear 220 and the paper discharge unit-side gear 211, when the recording sheet 202 passes through the nip region 203, the paper discharge unit-side gear 211 can be rotated at a rotating speed higher than the before-acceleration rotating speed. This makes it possible to prevent occurrence of tooth jumping between the fixing roller driving gear 220 and the paper discharge unit-side gear 211, and thereby prevent the conveyance of the recording sheet 202 from being impeded.

Moreover, in this embodiment, the image forming apparatus 100 is provided with the excellent fixing unit 7 thus far described. Accordingly, there can be realized the image forming apparatus 100 capable of forming high-quality images free from impressions made by a roller such as the post-fixing driven roller element 76.

In the embodiment thus far described, when it is determined in Step S4 shown in FIG. 9 that the recording sheet 202 is heavy paper, the procedure proceeds to Step S5 where the rotating speed of the paper discharge unit-side gear 211 is increased. However, the invention is not limited thereto but may be so designed that, when the recording sheet 202 is determined to be gloss paper, the rotating speed of the paper discharge unit-side gear 211 is increased, or so designed that, when the recording sheet 202 is determined to be any of heavy paper and gloss paper, the rotating speed of the paper discharge unit-side gear 211 is increased. Also in the case of gloss paper, for example, when a person in charge of operation places the recording sheet 202 in the paper-feeding cassette, with the advance registration of gloss paper as the type of paper for use, the determination that the recording sheet 202 is gloss paper can be made.

Thus, the judgment as to whether or not the thickness dimension of the recording sheet 202 is greater than or equal to the acceleration-adapted thickness dimension may be made on the basis of either the actually measured thickness dimension of the recording sheet 202 or the type of the recording sheet 202.

Further, while, in this embodiment, the heat roller 71 and the pressure roller 72 are each an elastic roller, by way of another embodiment of the invention, any one of the heat roller 71 and the pressure roller 72 may be realized by using a rigid roller. Even if one of the heat roller 71 and the pressure roller 72 is formed of a rigid roller, so long as the other is formed of an elastic roller, when the rollers are brought into pressure-contact with each other, the surface part of the elastic roller undergoes deformation, which leads to an increase in the rotating speed of the paper discharge unit-side gear 211 as described previously. That is, it is possible to achieve the same effects as achieved in this embodiment.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A fixing device for fixing a toner image formed on a recording medium, onto the recording medium, comprising:

a fixing roller having a gear wheel, the fixing roller being driven to rotate about a predetermined axis of rotation under a driving force transmitted thereto via the gear wheel;

a pressure roller disposed in pressure-contact with the fixing roller so as to be rotatable depending on a rotation of the fixing roller, the pressure roller holding and conveying a recording medium on which is formed a toner image in cooperation with the fixing roller in a nip region where the pressure roller and the fixing roller abut against each other;

a driving section having a driving gear wheel engageable with the gear wheel of the fixing roller, for driving the fixing roller by rotating the driving gear wheel; and a control section for, after determining that conditions for acceleration including coincidence between a nip region-to-recording medium positional relationship and a predetermined acceleration-adapted positional relationship are fulfilled, effecting control of the driving section in a manner so as to increase a rotating speed of the driving gear wheel to allow the driving gear wheel to rotate at a rotating speed higher than a before-acceleration rotating speed over a predetermined high-speed rotating period.

2. The fixing device of claim 1, wherein the acceleration-adapted positional relationship is a positional relationship between the recording medium and the nip region established at a point of time when an upstream-side end of the recording medium in its conveyance direction reaches the nip region.

3. The fixing device of claim 2, wherein the high-speed rotating period is set to a predicted value of the time which has elapsed between the arrival at the nip region of the upstream-side end of the recording medium in the conveyance direction and the completion of passage of the end through the entire nip region.

4. The fixing device of claim 3, wherein the control section controls the driving section in such a manner that, among the rotating speeds of the driving gear wheel for the duration of passage of the upstream-side end of the recording medium in the conveyance direction through the nip region, a rotating speed of the driving gear wheel for a point of time when the end passes through a midportion between both ends of the nip region in the recording-medium conveyance direction rises to a maximum.

5. The fixing device of claim 4, wherein, after determining that the upstream-side end of the recording medium in the conveyance direction has passed through the midportion between both ends of the nip region in the recording-medium conveyance direction, the control section effects control of the driving section in a manner so as to decrease the rotating speed of the driving gear wheel.

6. The fixing device of claim 1, further comprising a detecting section which is located upstream of the nip region in the recording-medium conveyance direction, for detecting the recording medium, wherein the control section determines, when a length of time that has elapsed since recording-medium detection by the detecting section is found to be greater than or equal to a predetermined waiting time for acceleration, that the positional relationship between the nip region and the recording medium conforms to the acceleration-adapted positional relationship.

7. The fixing device of claim 6, wherein the waiting time for acceleration is set to a predicted value of the time which has elapsed between recording-medium detection by the detecting section and the arrival at the nip region of the upstream-side end of the recording medium in the conveyance direction.

8. The fixing device of claim 1, wherein the conditions for acceleration include a condition that the thickness dimension of the recording medium is greater than or equal to a predetermined acceleration-adapted thickness dimension.

9. An image forming apparatus comprising:

a toner image forming section for forming a toner image on a recording medium; and the fixing device of claim 1, for fixing the toner image formed on the recording medium.

* * * * *